US012146712B2

(12) United States Patent
Huber et al.

(10) Patent No.: US 12,146,712 B2
(45) **Date of Patent: *Nov. 19, 2024**

(54) STACKED PANEL HEAT EXCHANGER FOR AIR COOLED INDUSTRIAL STEAM CONDENSER

(71) Applicant: Evapco, Inc., Taneytown, MD (US)

(72) Inventors: Mark Huber, Frederick, MD (US); Jean-Pierre Libert, Frederick, MD (US)

(73) Assignee: Evapco, Inc., Taneytown, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/162,055

(22) Filed: Jan. 31, 2023

(65) Prior Publication Data

US 2023/0251039 A1 Aug. 10, 2023

Related U.S. Application Data

(63) Continuation of application No. 17/684,883, filed on Mar. 2, 2022, now Pat. No. 11,566,845.

(60) Provisional application No. 63/155,550, filed on Mar. 2, 2021.

(51) Int. Cl.
*F28B 1/06* (2006.01)
*F28F 1/02* (2006.01)

(52) U.S. Cl.
CPC ..... *F28B 1/06* (2013.01); *F28F 1/02* (2013.01); *F28B 2001/065* (2013.01); *F28F 2280/00* (2013.01)

(58) Field of Classification Search
CPC ..... F28B 1/06; F28B 2001/065; F28B 7/00; F28B 9/10; F28F 1/02; F28F 2280/00
See application file for complete search history.

(56) References Cited

U.S. PATENT DOCUMENTS

| | | | | |
|---|---|---|---|---|
| 4,190,102 | A * | 2/1980 | Gerz | F28B 1/06 165/113 |
| 5,139,083 | A * | 8/1992 | Larinoff | F28B 9/005 165/113 |
| 5,765,629 | A * | 6/1998 | Goldsmith | F28B 9/10 165/113 |
| 2010/0276129 | A1* | 11/2010 | Bodas | F01K 9/00 165/157 |
| 2017/0363358 | A1* | 12/2017 | Bugler, III | F28F 9/02 |

* cited by examiner

*Primary Examiner* — Travis Ruby
(74) *Attorney, Agent, or Firm* — Whiteford, Taylor & Preston, LLP; Peter J. Davis

(57) ABSTRACT

A stacked panel tube bundle for an air cooled steam condenser having two sets of condensing tubes, one set arranged above the other, the first (lower) set of tubes in direct fluid communication with a combined steam delivery/condensate collection manifold at a bottom end and in indirect fluid communication with a non-condensable collection manifold via an L-shaped extension member; the second (upper) set of tubes in direct fluid communication with the non-condensable collection manifold at the top, and in indirect fluid communication with the combined steam delivery/condensate collection manifold via an L-shaped extension member.

10 Claims, 11 Drawing Sheets

STACKED PANEL HEAT EXCHANGER FOR AIR COOLED INDUSTRIAL STEAM CONDENSER

BACKGROUND OF THE INVENTION

Field of the Invention

The present invention relates to large scale field erected air cooled industrial steam condensers ("ACCs).

Description of the Background

The typical large scale field erected air cooled industrial steam condenser is constructed of heat exchange bundles arranged in an A-frame arrangement above a large fan, with one A-frame per fan. Each tube bundle typically contains 35-45 vertically oriented flattened finned tubes, each tube approximately 11 meters in length by 200 mm in height, with semi-circular leading and trailing edges, and 18-22 mm external width. Each A-frame typically contains five to seven tube bundles per side.

The typical A-Frame ACC described above also includes both $1^{st}$ stage or "primary" condenser bundles (sometimes referred to as K-bundles for Kondensator or Kondenser) and 2nd stage or "secondary" condenser bundles (sometimes referred to as D-bundles for Dephlegmator). About 80% to 90% of the heat exchanger bundles are $1^{st}$ stage or primary condenser. In the $1^{st}$ stage of a conventional A-Frame ACC, the steam enters the top of the primary condenser bundles, and the condensate and some steam leave the bottom in a co-current condensing stage. While this conventional first stage configuration is thermally efficient, it does not provide a means for removing non-condensable gases. To sweep the non-condensable gases through the $1^{st}$ stage bundles, 10% to 20% of the heat exchanger bundles are configured as $2^{nd}$ stage or secondary condensers, typically interspersed among the primary condensers, which draw vapor from the lower condensate collection manifold. In this arrangement, steam and non-condensable gases travel through the $1^{st}$ stage condensers as they are drawn into the bottom of the secondary condenser. As the mixture of gases travels up through the secondary condenser, the remainder of the steam condenses, concentrating the non-condensable gases at the top while the condensate drains to the bottom. This conventional secondary condenser process is commonly referred to as the counter-current condensing stage. The tops of the secondary condensers are attached to a vacuum manifold which removes the non-condensable gases from the system.

Variations to the standard prior art ACC arrangement have been disclosed, for example in US 2015/0204611 and US 2015/0330709. These applications show the same finned tubes, but drastically shortened and then arranged in a series of small A-frames, typically five to six A-frames per fan. Part of the logic is to reduce the steam-side pressure drop, which has a small effect on overall capacity at summer condition, but greater effect at a winter condition. Another part of the logic is to weld the top steam manifold duct to each of the bundles at the factory and ship them together, thus saving expensive field welding labor. The net effect of this arrangement, with the steam manifold attached at the factory and shipped with the tube bundles, is a reduction of the tube length to accommodate the manifold in a shipping container.

Additional variations to the prior art ACC arrangements are disclosed, for example in US 2017/0363357 and US 2017/0363358. These applications disclose a new tube construction for use in ACCs having a cross-sectional height of 10 mm or less. US 2017/0363357 also discloses a new ACC arrangement having heat exchanger bundles in which the primary condenser bundles are arranged horizontally along the longitudinal axis of the bundles and the secondary bundles are arranged parallel to the transverse axis. US 2017/0363358 discloses an ACC arrangement in which all of the tube bundles are secondary bundles.

SUMMARY OF THE INVENTION

The present invention is directed to a novel and non-obvious "stacked panel" heat exchange tube bundle particularly suited for air cooled industrial steam condensers in which the heat exchange tube bundle has a first set of flat finned tubes arranged in a single row parallel to one-another; a second set of flat finned tubes above the first set of tubes and also arranged in a single row parallel to one-another; a first conduit, having a first conduit vertical segment, and a first conduit horizontal segment; where a bottom of the first conduit vertical segment is in fluid communication with a bottom manifold (for example, a combined steam delivery/condensate collection manifold or a combined condensate/non-condensable gas collection manifold); and where a top of the first conduit horizontal segment is in fluid communication with bottoms of the second set of flat finned tubes. The invention further includes a second conduit having a second conduit horizontal segment and a second conduit vertical segment, where a bottom of the second conduit horizontal segment is in fluid communication with tops of the first set of flat finned tubes, and a top of the second conduit vertical segment is in fluid communication with a top manifold, for example, an inter-condenser manifold. Additionally, the second set of flat finned tubes is separated from the first set of flat finned tubes by the first conduit horizontal segment and the second conduit horizontal segment, and the first conduit horizontal segment is located above the second conduit horizontal segment.

There is further provided according to the invention an air cooled steam condenser comprising heat exchange panels which include at least one stacked panel tube bundles of the invention.

There is further provided according to the invention an air cooled steam condenser comprising pairs of said heat exchange panels arranged in A-frames.

There is further provided according to the invention an air cooled steam condenser comprising pairs of said heat exchange panels arranged in V-shapes.

There is further provided according to the invention a large scale field erected air cooled industrial steam condenser connected to an industrial steam producing facility, comprising a single or plurality of condenser streets, each condenser street comprising a row of condenser modules, each condenser module comprising a plenum section having a single fan or multiple fans drawing air through a plurality of heat exchanger panels supported in a heat exchanger section, and each heat exchanger panel having a longitudinal axis and a transverse axis perpendicular to its longitudinal axis; wherein each heat exchanger panel comprises at least one first stage or second stage stacked panel heat exchange tube bundle. According to further embodiments of the invention, the combined steam delivery/condensate collection manifold may have a single steam inlet. According to still further embodiments of the invention, each condenser module street has a steam distribution manifold below the heat exchanger section and arranged along an axis that is perpendicular to a longitudinal axis of said heat exchanger panels and extending a length of said condenser module street beneath a plurality of heat exchanger panels, the steam distribution manifold comprising plurality of connections adapted to connect to each said heat exchanger panel.

BRIEF DESCRIPTION OF THE DRAWINGS

The foregoing summary, as well as the following detailed description of the preferred invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

Figure 1A:
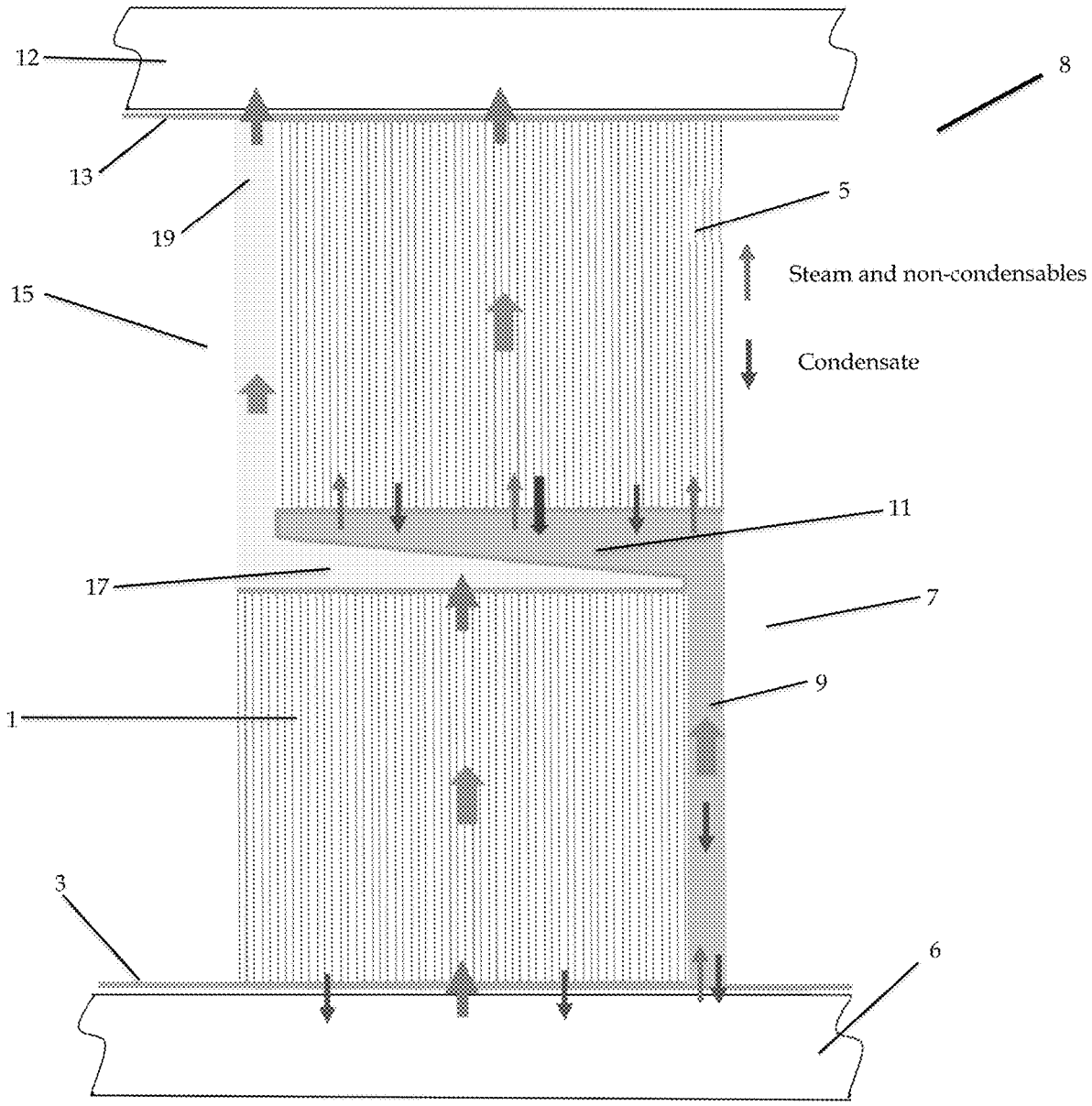
FIG. 1*a* is an elevation view schematic of a stacked panel tube bundle according to a first stage, or primary, tube bundle embodiment of the invention.

Features in the attached drawings are numbered with the following reference numerals:

- 1 lower set of tubes
- 2 heat exchanger panels
- 3 bottom tube sheet
- 5 upper set of tubes
- 6 combined steam delivery/condensate collection manifold (bottom bonnet)
- 7 combined steam delivery/condensate collection manifold extension
- 8 stacked panel primary condenser tube bundle
- 9 vertical leg of combined steam delivery/condensate collection manifold extension
- 11 transverse leg of combined steam delivery/condensate collection manifold extension
- 12 inter-condenser manifold (top bonnet)
- 13 top tube sheet
- 15 inter-condenser manifold extension
- 16 risers
- 17 transverse leg of inter-condenser manifold extension
- 18 steam inlet/condensate outlet
- 19 vertical leg of inter-condenser manifold extension
- 27 ACC cell/module
- 28 steam distribution manifold
- 33 combined condensate/non-condensable gas collection manifold
- 37 extension of combined condensate/non-condensable gas collection manifold
- 38 stacked panel secondary condenser tube bundle
- 39 vertical leg of extension of combined condensate/non-condensable gas collection manifold
- 41 transverse leg of extension of combined condensate/non-condensable gas collection manifold

DETAILED DESCRIPTION OF THE INVENTION

The invention presented herein is a new and improved tube bundle design for use in large scale field-erected air cooled industrial steam condensers for power plants and the like which provides significant improvements and advantages over the ACCs of the prior art.

Figure 2A:
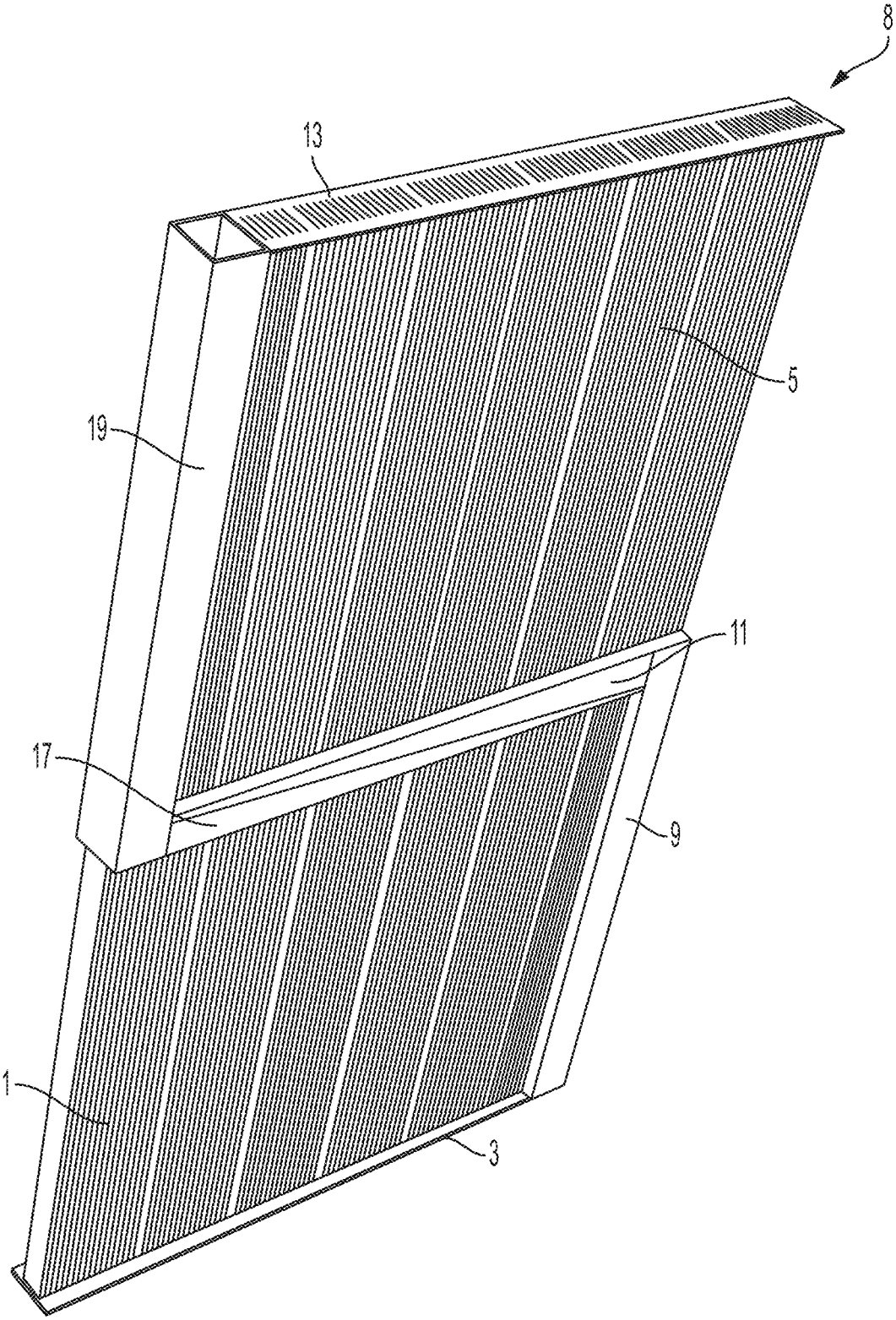
FIG. 2*a* is a perspective view of a stacked panel primary condenser tube bundle according to an embodiment of the invention.

According to an embodiment of the invention shown in FIGS. 1*a* and 2*a*, a stacked panel tube bundle 8 is presented having upper and lower sets of counterflow condensing tubes that serve as first stage condenser tubes. The lower set of tubes 1 is connected to bottom tube sheet 3 and receives steam directly from a combined steam delivery/condensate collection manifold or "bottom bonnet" 6 located directly beneath the underside of bottom tube sheet 3. Condensate that forms in the lower set of tubes 1 drains back down through the lower set of tubes and collects in the combined steam delivery/condensate collection manifold 6.

The upper set of tubes 5 receives steam from and delivers condensate to an extension 7 of the combined steam delivery/condensate collection manifold 6. The combined steam delivery/condensate collection manifold extension 7 may take the general form of an upside-down "L" in which a vertical leg 9 is located adjacent to the lower set of tubes 1 and is fluidly connected at its bottom to the combined steam delivery/condensate collection manifold 6 through tube sheet 3. A transverse leg 11 of the combined steam delivery/condensate collection manifold extension 7 extends between the upper and lower sets of tubes and supports the upper set of tubes 5. Steam travels up the vertical leg 9 of the upper combined steam delivery/condensate collection manifold extension 7, into the transverse leg 11, and into the upper set of tubes 5. Condensate travels in the opposite direction, down through the upper set of tubes 5, into the transverse leg 11 of the combined steam delivery/condensate collection manifold extension 7, into the vertical leg 9, and finally into combined steam delivery/condensate collection manifold 6. The bottom surface of the transverse leg 11 of the combined steam delivery/condensate collection manifold extension 7 may be inclined to assist drainage of condensate toward the vertical leg 9.

Non-condensables and uncondensed steam from the upper set of tubes 5 are drawn through top tube sheet 13 into inter-condenser manifold 12 arranged along the top of the upper set of tubes.

An extension 15 of the inter-condenser manifold 12 is provided to draw non-condensables and uncondensed steam from the lower set of tubes 1 to the inter-condenser manifold 12. The inter-condenser manifold extension 15 may take the general form of an L, having a transverse leg 17 that sits directly above the top of the lower set of tubes 1, and a vertical leg 19 that is situated adjacent the upper set of tubes 5. The transverse leg 17 of the inter-condenser manifold extension 15 rests between the tops of the lower set of tubes 1 and the transverse leg 11 of the combined steam delivery/condensate collection manifold extension 7. The upper surface of the transverse leg 17 of the inter-condenser manifold extension 15 may have an inclined surface to match the inclined bottom surface of the transverse leg 11 of the combined steam delivery/condensate collection manifold extension 7. The inter-condenser manifold extension 15 collects non-condensables and uncondensed steam from the lower set of tubes 1 and delivers it to the inter-condenser manifold 12.

Figure 1B:
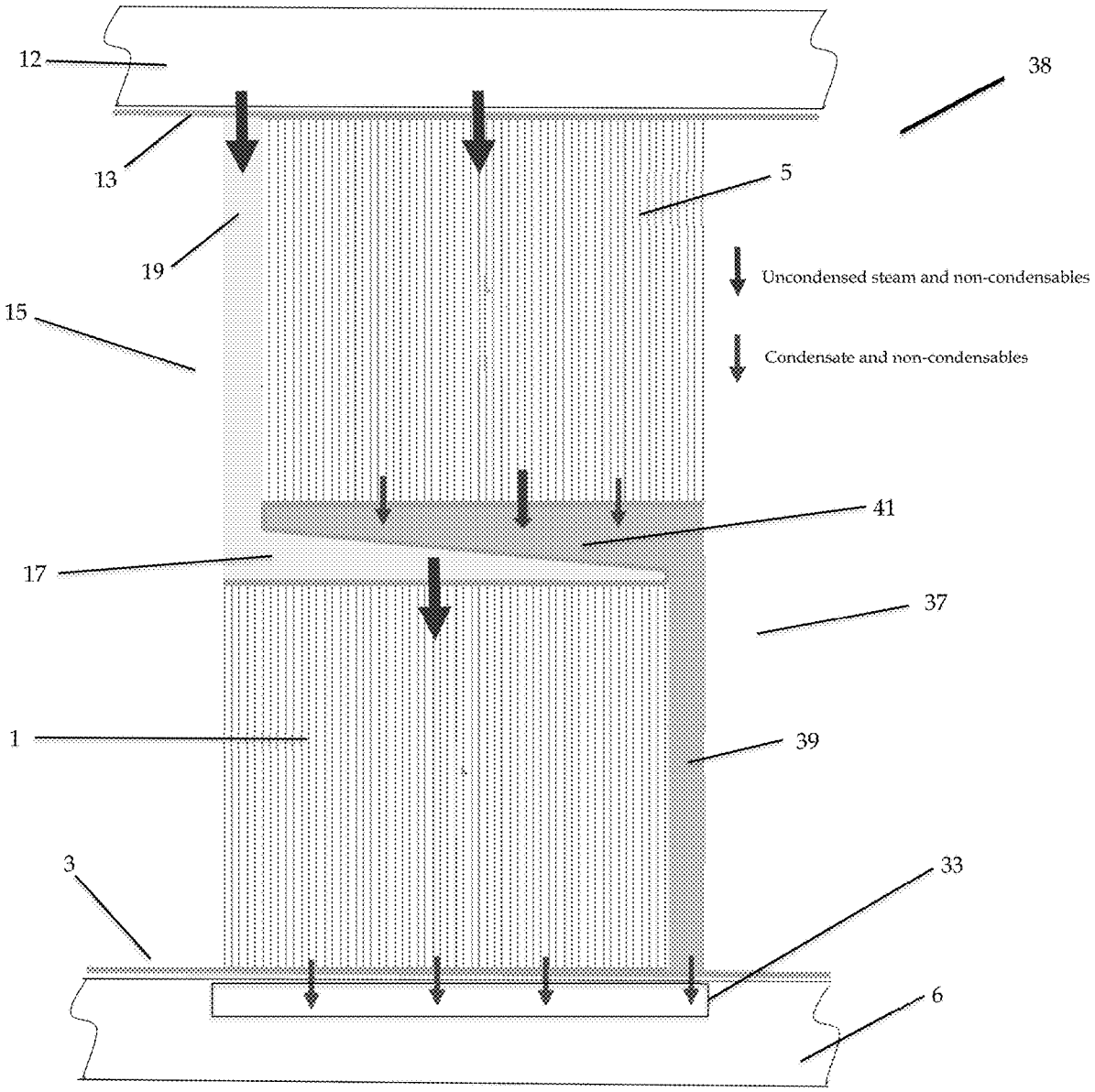
FIG. 1*b* is an elevation view schematic of a stacked panel tube bundle according to a second stage, or secondary, tube bundle embodiment of the invention.
Figure 2B:
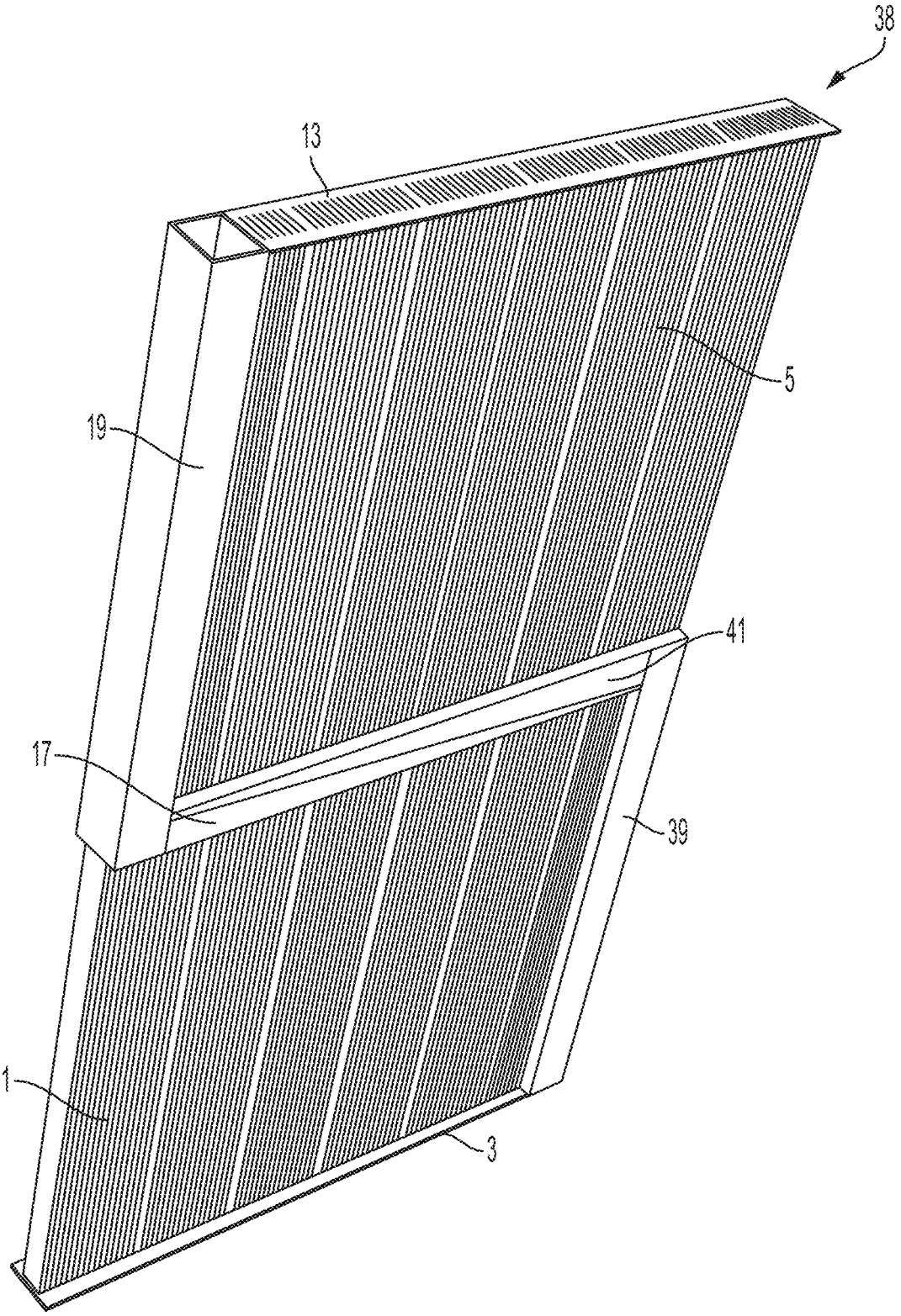
FIG. 2*b* is perspective view of a stacked panel secondary condenser tube bundle according to an embodiment of the invention.

According to another embodiment of the invention, a slightly modified stacked panel tube bundle of the invention may serve as a second stage condenser. According to this embodiment, shown in FIGS. 1*b* and 2*b*, a stacked panel tube bundle 38 is presented having upper and lower sets of co-current condensing tubes that receive uncondensed steam and non-condensables from primary condenser bundles via the inter-condenser manifold 12. The upper set of tubes 5 receive uncondensed steam and non-condensables from the inter-condenser manifold 12, through top tube sheet 13. The lower set of tubes 1 receive uncondensed steam and non-condensables from the inter-condenser manifold 12 via an "L"-shaped extension 15 of the inter-condenser manifold 12. Inter-condenser manifold extension 15 has a vertical leg 19 which is adjacent the upper set of tubes and which is fluidically connected at its top end to inter-condenser manifold 12 via top tube sheet 13. The lower end of vertical leg 19 of inter-condenser manifold extension 15 is connected to transverse leg 17 of the inter-condenser manifold extension 15, and the bottom surface of transfer leg 17 is open to the tops of the lower set of tubes 1.

The bottoms of the lower set of tubes 1 are connected to bottom combined condensate/non-condensable gas collection manifold 33 via bottom tube sheet 3. Thus, the lower set of tubes 1 condense the uncondensed steam and accumulate the non-condensable gases and deliver them directly to the combined condensate/non-condensable gas collection manifold 33 for removal from the system.

The bottoms of the upper set of tubes 5 are connected to extension 37 of the combined condensate/non-condensable gas collection manifold 33. The combined condensate/non-condensable gas collection manifold extension 37 may take the general form of an upside-down "L" in which a vertical leg 39 is located adjacent to the lower set of tubes 1 and is fluidly connected at its bottom to the combined condensate/non-condensable gas collection manifold 33. A transverse leg 41 of the combined condensate/non-condensable gas collection manifold extension 37 extends between the upper and lower sets of tubes and supports the upper set of tubes 35. Condensate and non-condensable gases from the upper set of tubes 5 travel through the transverse leg 41 of the combined condensate/non-condensable gas collection manifold extension 37, down the vertical leg 39 of the combined condensate/non-condensable gas collection manifold extension 37, and into the combined condensate/non-condensable gas collection manifold 33. The transverse leg 41 of the combined condensate/non-condensable gas collection manifold extension 37 rests between the transverse leg 11 of the inter-condenser manifold extension 15 and the bottom of the top set of tubes 5. The bottom surface of the transverse leg 41 of the combined condensate/non-condensable gas collection manifold extension 37 may be inclined to assist drainage of condensate toward the vertical leg 39.

According to one embodiment, a plurality of stacked panel first stage tube bundles 8 and one more stacked panel second stage tube bundles 38 according to the invention may be used to form a heat exchanger panel 2 for an air cooled condenser, for example as shown in FIGS. 3, 4, 5, 6 and 7. A majority of the plurality of stacked panel first stage tube bundles 8 may be connected at their bottom to a bottom tube sheet 3. A combined steam delivery/condensate collection manifold or "bottom bonnet" 6 may be connected to the bottom of the tube sheet 3. The bottom bonnet 6 runs the length of the heat exchanger panel 2. The bottom bonnet 6 is in fluid communication with the lower set of tubes 1 via tube sheet 3 and with the upper set of tubes 5 via tube sheet 3 and extension 7. One or more stacked panel second stage tube bundles 38 may be arranged adjacent one or more stacked panel first stage tube bundles 8, fluidically connected at their top ends by an inter-condenser manifold 12 configured to deliver uncondensed steam and non-condensable gases to the stacked panel second stage tube bundles 38. The stacked panel second stage tube bundles 38 have at their bottoms a combined condensate/non-condensable gas collection manifold 33 which in turn is attached to a vacuum manifold which removes the non-condensable gases from the system.

The combined steam delivery/condensate collection manifold 6 may be rectangular, circular or elliptical in cross-section, and according to a preferred but non-limiting embodiment, may be fitted at the center point of its length with a single steam inlet/condensate outlet 18 which receives all the steam for the heat exchanger panel 2 from steam delivery manifold 28 and which serves as the outlet for condensate collected from the tube bundle.

In operation, steam is provided to the steam inlet/condensate outlet 18 from steam delivery manifold 28. From the steam inlet/condensate outlet 18, steam spreads through the combined steam delivery/condensate collection manifold 6 and into primary condensers 8. Steam travels into the bottoms of lower tubes 1 and through vertical segment 9 and horizontal segment 11 of extension 7 into upper tubes 5 of primary condensers 8. Condensate formed in upper and lower tubes travels in the reverse direction back into combined steam delivery condensate collection manifold 6, steam inlet/condensate outlet 18, and steam delivery manifold 28. Uncondensed steam and non-condensable gases flow into the top bonnet 12 from the stacked panel first stage heat exchange bundles 8 and are drawn away from the top bonnet 12 to the stacked panel secondary/second stage heat exchange bundles 38. Uncondensed steam and non-condensables travel down through the upper set of tubes 5 and through vertical segment 19 and horizontal segment 17 of extension 15 to lower set of tubes 1. Condensate and non-condensable gases from the lower set of tubes travel into the combined condensate/non-condensable gas collection manifold 33. Condensate and non-condensable gases from the upper set of tubes pass through horizontal segment 41 and vertical segment 39 of extension 37 into the combined condensate/non-condensable gas collection manifold 33. Non-condensable gases are subsequently removed from the system via vacuum manifold (not shown). Condensate in the combined condensate/non-condensable gas collection manifold 33 flows into combined steam delivery/condensate collection manifold 6 where it joins condensate formed in the primary condenser tube bundles.

According to some embodiments, the steam inlet/condensate outlet 18 for the heat exchanger panel 2 and the steam inlet/condensate outlets 18 for all of the heat exchanger panels in the same ACC cell/module 27 may be connected to a large cylinder or steam distribution manifold 28 which may be located beneath the heat exchanger panels 2 and which may run perpendicular to the longitudinal axis of the heat exchanger panels 2 at their midpoints. According to other embodiments, steam inlet/condensate outlets 18 may be connected to vertical risers 16 which in turn may be connected to a steam distribution manifold 28 which is located at or near ground level, or at some intermediate height; see e.g., FIGS. 4-9

Figure 4:
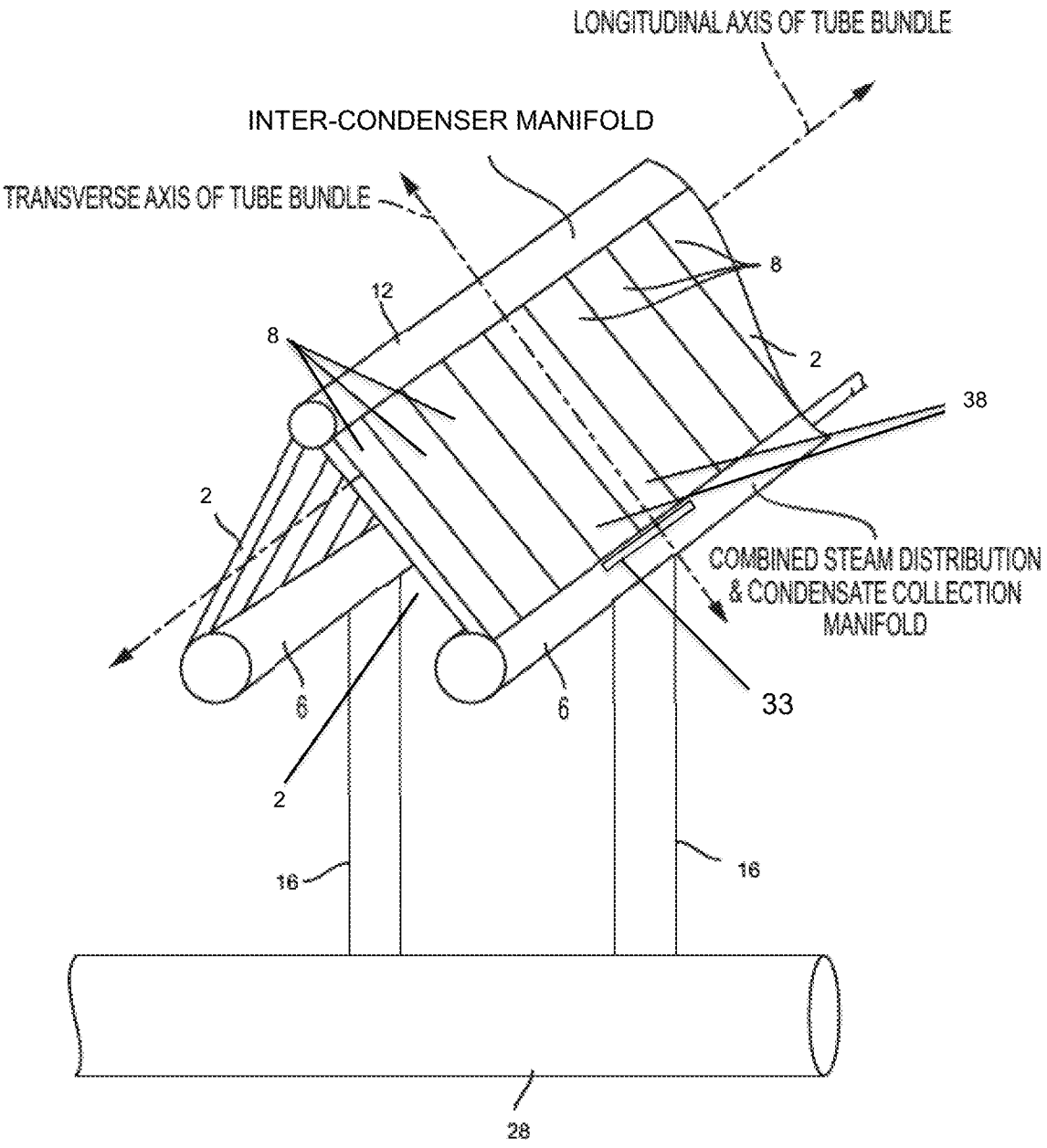
FIG. 4 is a perspective view representation of the heat exchange portion of a large scale field erected air cooled industrial steam condenser according to an embodiment of the invention in which pairs of heat exchange panels comprising stacked panel tube bundles are arranged in an A-frame with a common inter-condenser manifold at the top.

Referring to an embodiment represented by FIG. 4, pairs of tube bundles 2 comprised of stacked panel primary tube bundles 8 and secondary tube bundles 38 may be arranged in an A-frame configuration. The longitudinal axes of the tubes in the tube bundles 2 are aligned parallel with the transverse axis of the tube bundle, each stacked panel tube bundle generally oriented 25°-35° degrees, and preferably 30°, from the vertical). Combination steam distribution/condensate collection manifolds 6 are attached at the bottom of each of tube bundle. A single inter-condenser manifold 12 is attached to the top of both bundles 2 to collect the uncondensed steam and non-condensable gases that travel to the top of the stacked panel primary tube bundles 8. Stacked panel secondary tube bundles 38 receive uncondensed steam and non-condensable gases from the inter-condenser manifold, condense the steam and deliver condensate and non-condensable gases to the combined condensate/non-condensable gas collection manifold 33. Steam is supplied to midpoints of the combined steam distribution/condensate collection manifold 6 from steam distribution manifold 28 via risers 16. Condensed water that collects in the combined steam distribution/condensate collection manifold 6 is carried away from the ACC in a condensate recovery tube.

Figure 5:
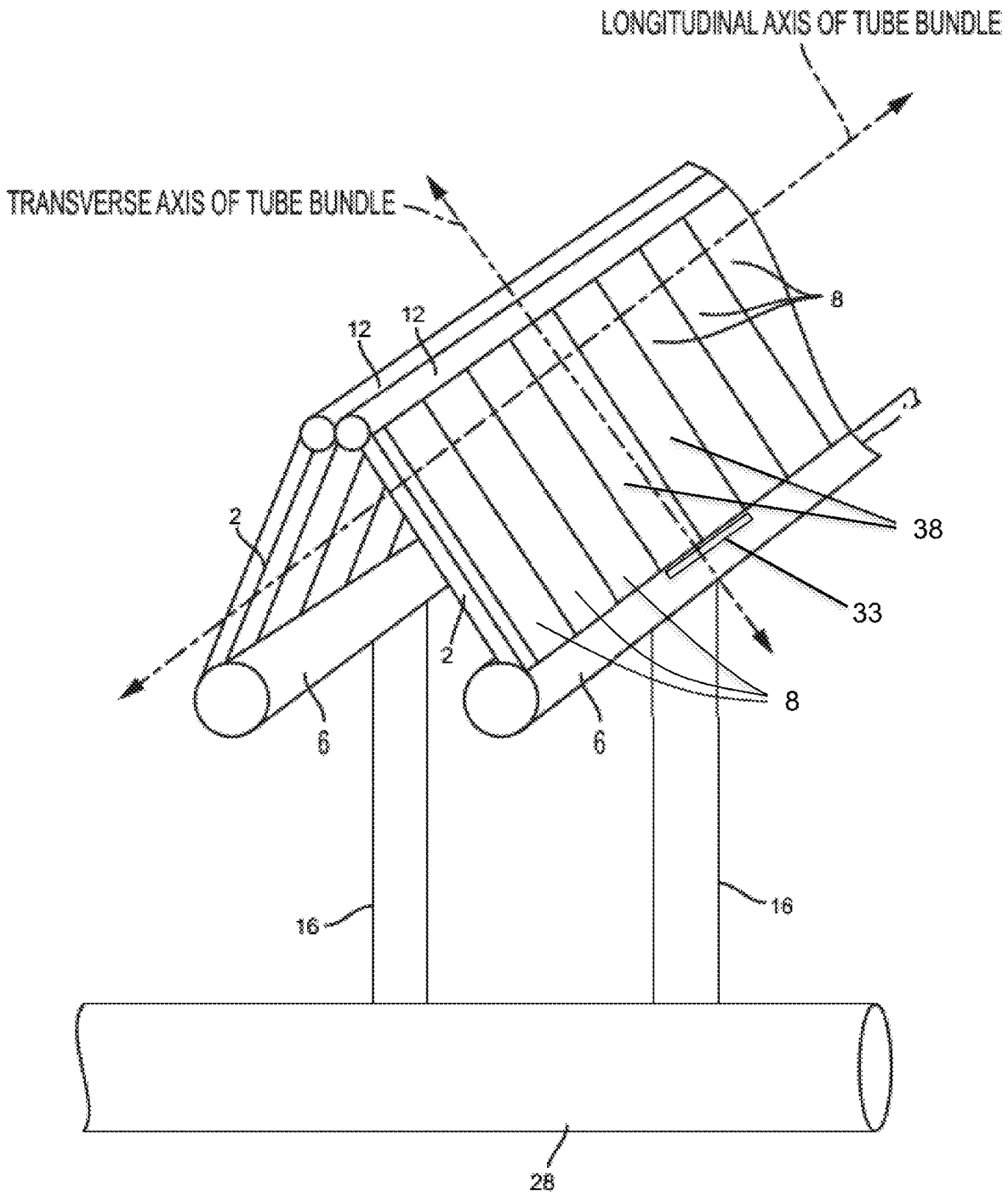
FIG. 5 is a perspective view representation of the heat exchange portion of a large scale field erected air cooled industrial steam condenser according to an embodiment of the invention in which pairs of heat exchange panels comprising stacked panel tube bundles are arranged in an A-frame with each heat exchange panel of a pair having dedicated inter-condenser manifolds at their tops and dedicated steam delivery/condensate collection manifolds at their bottoms.

FIG. 5 shows an embodiment very similar to the A-frame embodiment of FIG. 4, except that each tube bundle 2 in a pair is attached at its top to a dedicated inter-condenser manifold 12.

Figure 6:
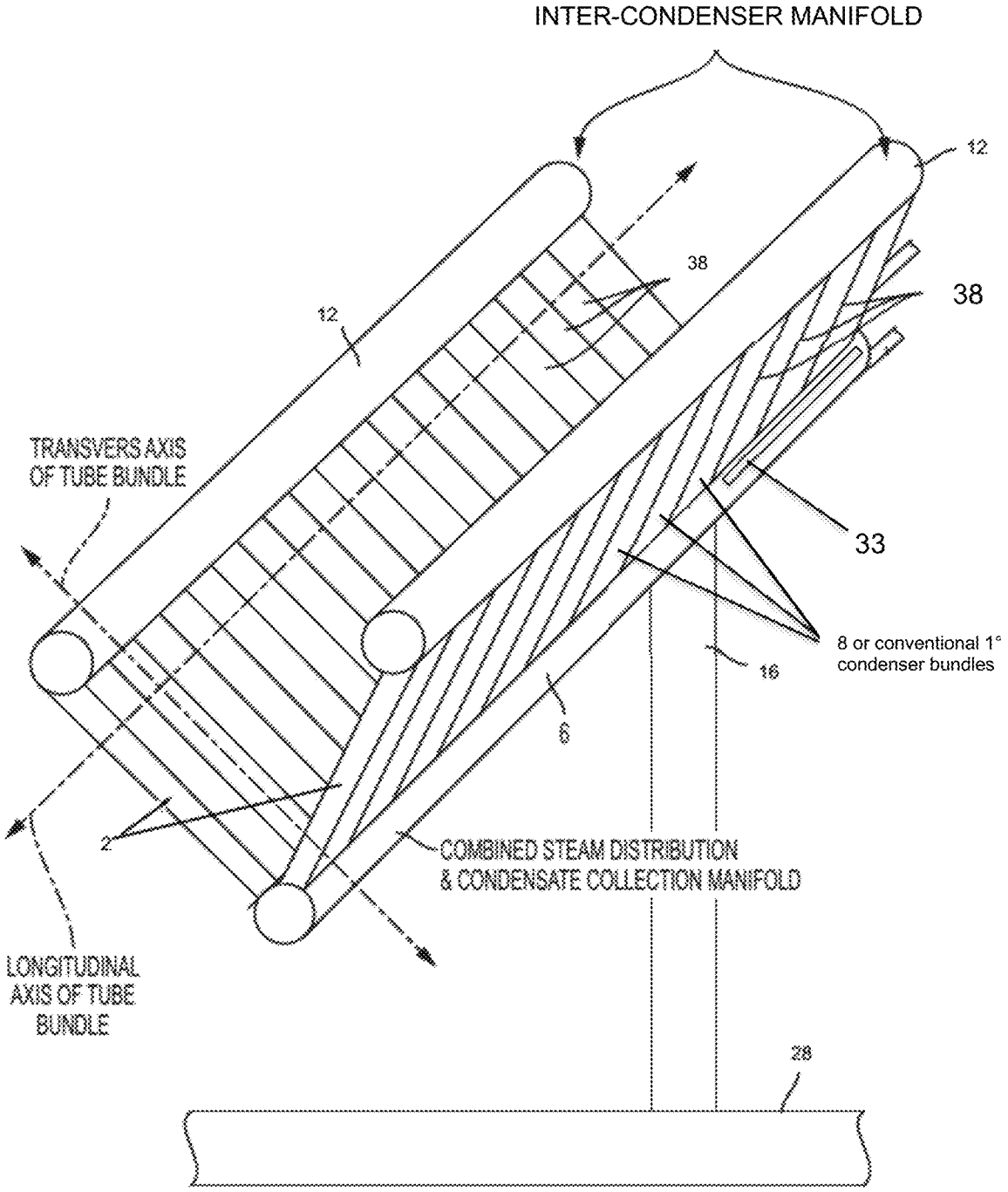
FIG. 6 is a perspective view representation of the heat exchange portion of a large scale field erected air cooled industrial steam condenser according to an embodiment of the invention in which pairs of heat exchange panels comprising stacked panel tube bundles are arranged in an V-shape with a common steam delivery/condensate collection manifold at their bottoms and inter-condenser manifolds at their tops.
Figure 7:
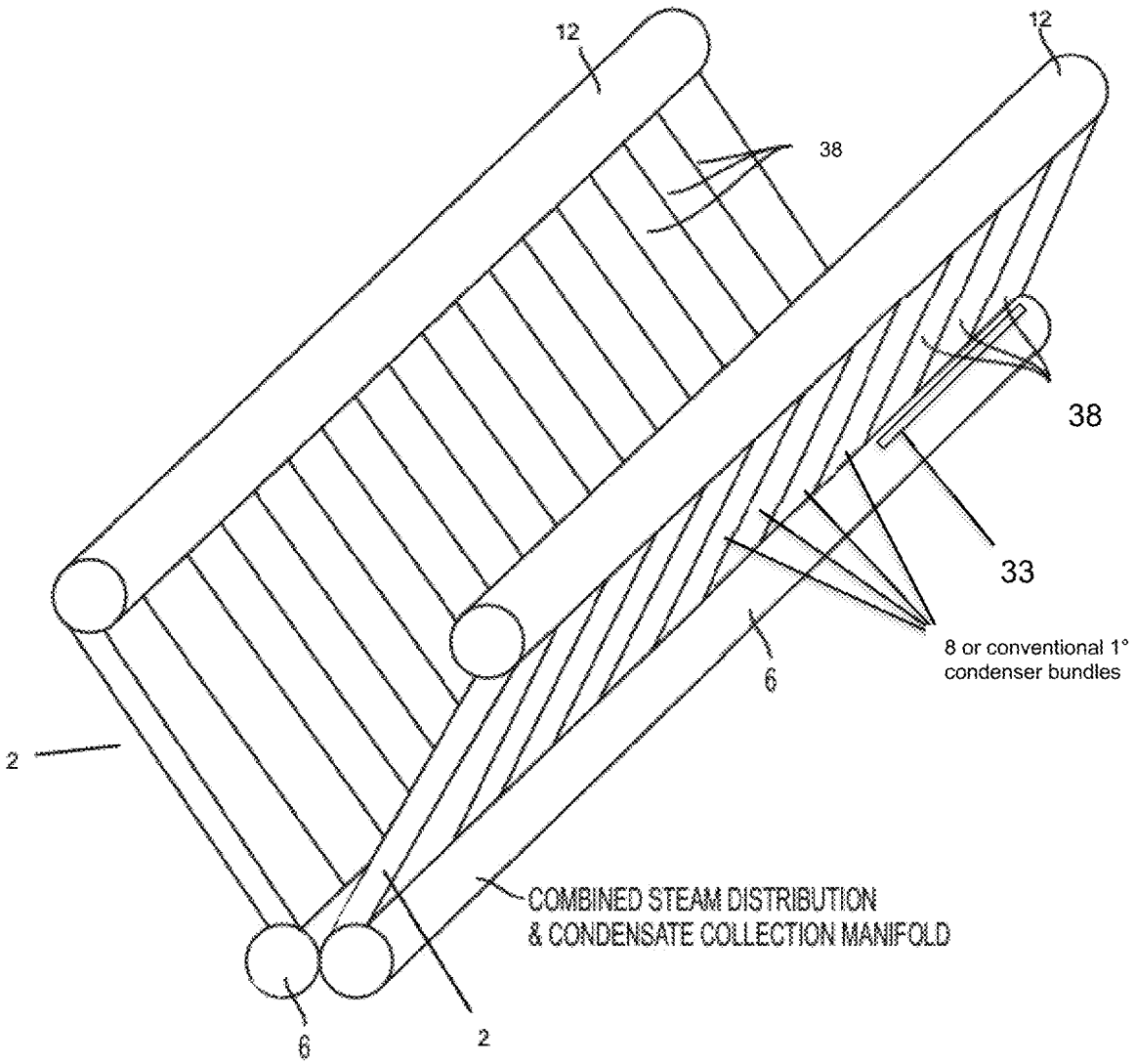
FIG. 7 is a perspective view representation of the heat exchange portion of a large scale field erected air cooled industrial steam condenser according to an embodiment of the invention in which pairs of heat exchange panels comprising stacked panel tube bundles are arranged in a V-shape with each heat exchange panel of a pair having dedicated inter-condenser manifolds at their tops and dedicated steam delivery/condensate collection manifolds at their bottoms.
Figure 8:
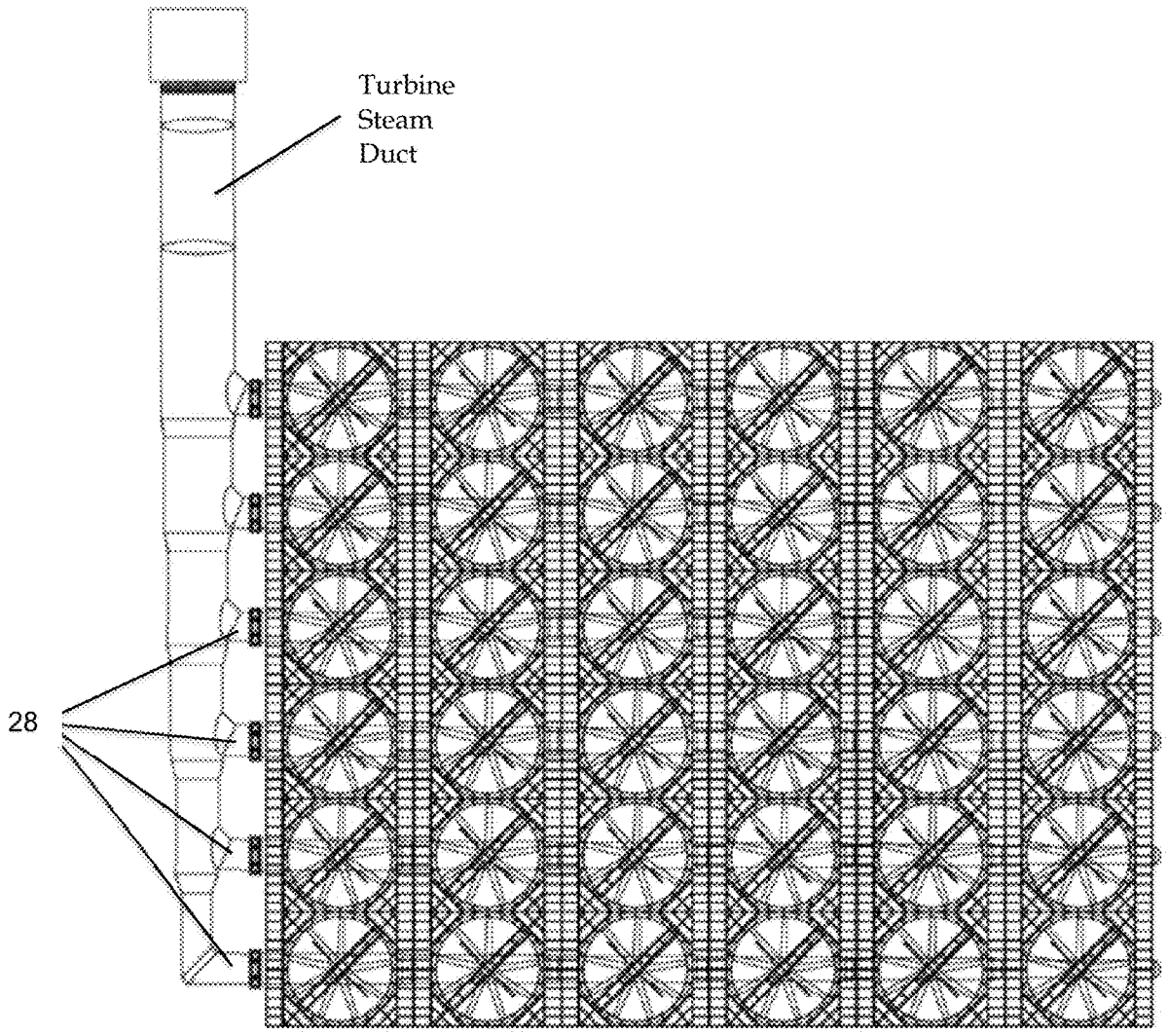
FIG. 8 is a plan view of a large scale field erected air cooled industrial steam condenser according to an embodiment of the invention having heat exchanger panels including stacked panel condenser bundles, with steam distribution manifolds passing under the center of each row of ACC modules.
Figure 9:
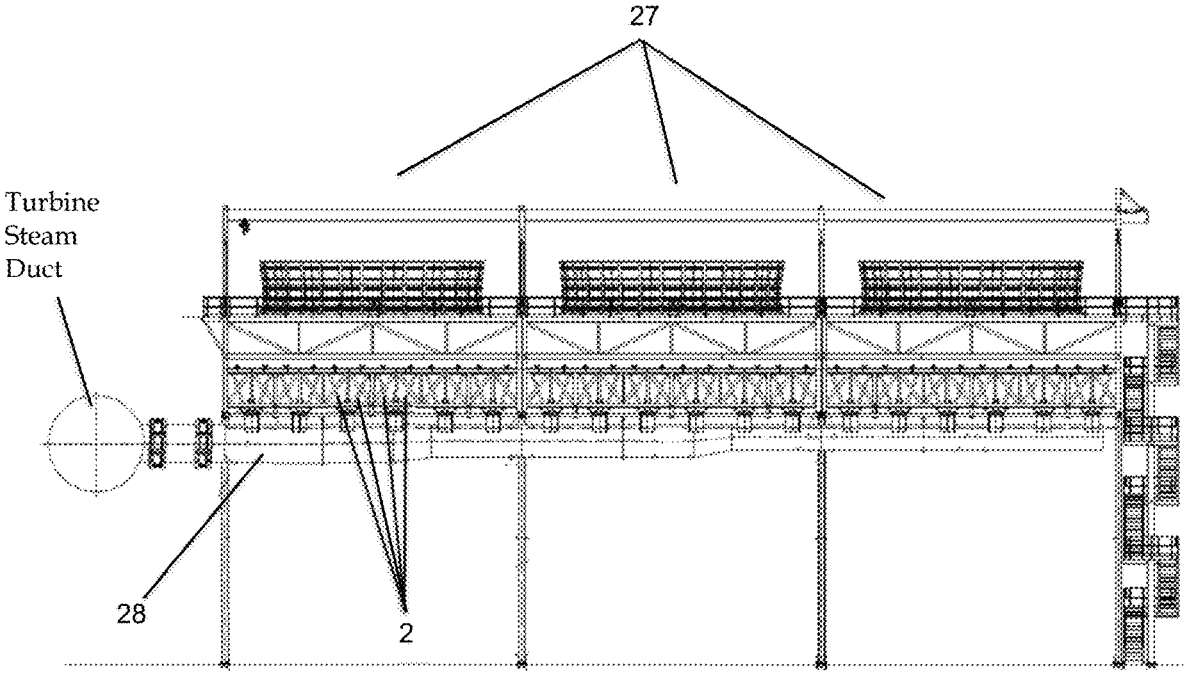
FIG. 9 is side view of a large scale field erected air cooled industrial steam condenser according to an embodiment of the invention having heat exchanger panels including stacked panel condenser bundles, with a steam distribution manifold located beneath the heat exchanger panels and connected to a turbine steam duct.

Referring to embodiment represented by FIGS. 6 and 7, pairs of tube bundles 2 comprised of stacked panel primary tube bundles 8 and secondary tube bundles 38 may be arranged in an V-frame configuration. As shown in FIGS. 6 and 7, the steam distribution manifold 28 may extend perpendicular to the longitudinal axes of the tube bundles 2 beneath the midpoints of the tube bundles 2 and may be connected to the midpoints of the combined steam distribution/condensate collection manifolds by risers 16. According to an alternative embodiment, steam distribution manifold 28 may be supported directly beneath the combined steam distribution/condensate collection manifolds, thereby obviating the need for risers 16.

Figure 3:
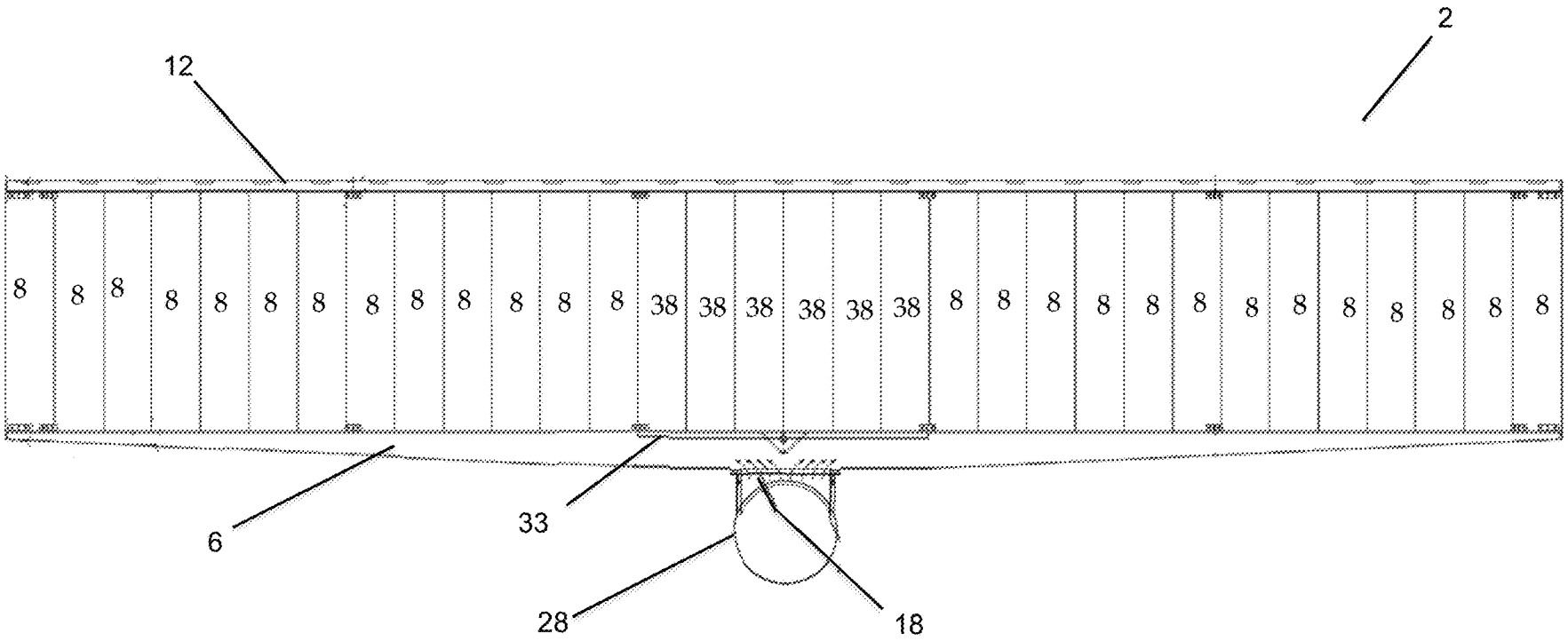
FIG. 3 is an elevation view schematic of an air cooled condenser heat exchange panel having two sets of stacked panel first stage condenser tube bundles flanking a centrally located set of stacked panel second stage condenser tube bundles according to an embodiment of the invention.

The stacked panel tube bundles of the invention may be used with configuration of ACC, using tubes of any dimension. While FIGS. 3-5 show centrally located secondary condenser bundles 38 flanked by sets of primary condenser bundles 8, it is contemplated that according to various alternative configurations, one or more secondary condenser bundles 38 may be placed at either or both ends of the heat exchanger panel 2 (see FIGS. 6 and 7), or interspersed among larger sets of primary condenser bundles 8 along the heat exchanger panel 2. Additionally it is further contemplated that stacked panel primary and/or secondary condenser bundles of the invention may be used in ACC heat exchange panels in combination with conventional (or other unconventional) primary and/or secondary condenser bundles.

The stacked tube arrangement of the present invention may be used in the Advanced Large Scale Field-Erected Air Cooled Industrial Steam Condenser disclosed in U.S. Published Patent Application US 2020/0333078, the disclosure of which is incorporated herein in its entirety, either in place of or in combination with the tube bundles (heat exchange panels) disclosed therein.

Every embodiment disclosed herein is contemplated to be used with every other disclosed and compatible embodiment.

It will be appreciated by those skilled in the art that changes could be made to the preferred embodiments described above without departing from the inventive concept thereof. It is understood, therefore, that this invention is not limited to the particular embodiments disclosed, but it is intended to cover modifications within the spirit and scope of the present invention as outlined in the present disclosure and defined according to the broadest reasonable reading of the claims that follow, read in light of the present specification.

The invention claimed is:

1. A heat exchange tube bundle comprising:

a first set of condenser tubes arranged parallel to one-another;

a second set of condenser tubes arranged parallel to one-another, above said first set of condenser tubes;

a first conduit, having a first conduit vertical segment and a first conduit horizontal segment, said first conduit vertical segment and said first conduit horizontal segment in fluid communication with one-another; a bottom of said first conduit vertical segment in fluid communication with a bottom manifold; a top of said first conduit horizontal segment in fluid communication with bottoms of said second set of condenser tubes; and a second conduit, having a second conduit horizontal segment and a second conduit vertical segment, said second conduit horizontal segment and said second conduit vertical segment in fluid communication with one-another; a bottom of said second conduit horizontal segment in fluid communication with tops of said first set of condenser tubes; a top of said second conduit vertical segment in fluid communication with a top manifold;

said second set of condenser tubes separated from said first set of condenser tubes by said first conduit horizontal segment and said second conduit horizontal segment; said first conduit horizontal segment located above said second conduit horizontal segment.

2. The heat exchange tube bundle according to claim 1, wherein said heat exchange tube bundle is a first stage condenser, said bottom manifold is a combined steam delivery/condensate collection manifold, and said top manifold is an inter-condenser manifold.

3. The heat exchange tube bundle according to claim 1, wherein said heat exchange tube bundle is a second stage condenser, said bottom manifold is a combined condensate/non-condensable gas collection manifold, and said top manifold is an inter-condenser manifold.

4. An air cooled steam condenser comprising heat exchange panels, each said heat exchange panels comprising one or more heat exchange tube bundles according to claim 1.

5. The air cooled steam condenser according to claim 4 comprising pairs of said heat exchange panels arranged in A-frames.

6. The air cooled steam condenser according to claim 4 comprising pairs of said heat exchange panels arranged in V-shapes.

7. A large scale field erected air cooled industrial steam condenser connected to an industrial steam producing facility, comprising:

a single or plurality of condenser streets, each condenser street comprising a row of condenser modules, each condenser module comprising a plenum section having a single fan or multiple fans drawing air through a plurality of heat exchanger panels supported in a heat exchanger section, and each heat exchanger panel having a longitudinal axis and a transverse axis perpendicular to its longitudinal axis, each heat exchanger panel comprising at least one heat exchange tube bundle according to claim 1.

8. The large scale field erected air cooled industrial steam condenser according to claim 7, said combined steam delivery/condensate collection manifold having a single steam inlet on a bottom surface thereof.

9. The large scale field erected air cooled industrial steam condenser according to claim 7, wherein each said condenser module street comprising a steam distribution manifold below said heat exchanger section and arranged along an axis that is perpendicular to a longitudinal axis of said heat exchanger panels and extending a length of said condenser module street beneath a plurality of heat exchanger panels, said steam distribution manifold comprising plurality of connections on a top surface thereof adapted to connect to each said single steam inlet.

10. A heat exchange tube bundle comprising:

a top manifold;

a bottom manifold;

a set of upper tubes, tops of said upper tubes connected to said top manifold;

a set of lower tubes, said set of lower tubes located below said set of upper tubes, bottom ends of said lower tubes connected to said bottom manifold;

a first conduit having a first conduit horizontal leg and a first conduit vertical leg a second conduit having a second conduit vertical leg and a second conduit horizontal leg;

a bottom of said first conduit vertical leg connected to said bottom manifold, and a top surface of said first conduit horizontal leg connected to bottoms of said upper tubes and configured to deliver steam from said bottom manifold to said upper tubes;

a bottom surface of said second conduit horizontal leg connected to tops of said lower tubes, and a top of said second conduit vertical leg connected to said top manifold, said second conduit configured to deliver uncondensed steam and non-condensables from said lower tubes to said top manifold; said upper tubes separated from said lower tubes by said first conduit horizontal leg and said second conduit horizontal leg.

* * * * *